US005098212A

United States Patent [19]

Smit

[11] Patent Number: 5,098,212

[45] Date of Patent: Mar. 24, 1992

[54] PROPELLING PENCIL

[76] Inventor: Adrianus J. Smit, Fortsteenweg 32, 2232's Gravenwezel, Belgium

[21] Appl. No.: 537,514

[22] Filed: Jun. 13, 1990

[30] Foreign Application Priority Data

Jun. 21, 1989 [BE] Belgium ..... 08900677

[51] Int. Cl.[5] ..... B43K 21/22

[52] U.S. Cl. ..... 401/92

[58] Field of Search ..... 401/92, 93

[56] References Cited

U.S. PATENT DOCUMENTS 2,282,574 5/1942 Halbasch ..... 401/93

FOREIGN PATENT DOCUMENTS 34335 9/1908 Austria ..... 401/92
528582 3/1957 Belgium .
802200 8/1936 France ..... 401/92
1063000 4/1954 France .
492044 3/1954 Italy ..... 401/93
20511 of 1911 United Kingdom .
160079 4/1921 United Kingdom .
670777 4/1952 United Kingdom ..... 401/93
848022 9/1960 United Kingdom .

*Primary Examiner*—Danton D. DeMille
*Assistant Examiner*—Richard Johnson
*Attorney, Agent, or Firm*—Lackenbach Siegel Marzullo & Aronson

[57] ABSTRACT

Propelling pencil for pins, whether colored or not, which consists mainly of the combination of an elongated casing with an axial bore for housing a pencil pin which is provided at the top with a screw thread part, a screw head with an axial bore for passing the pin and of which the tailpiece is provided with a screw thread part which can be screwed into and moved in the screw thread part of the axial bore of the casing, the tail-piece being provided with several longitudinal grooves which run over a distance of the end of the tailpiece, and means being provided for gradually squeezing the middle part of the tail-piece in which the grooves are provided, between the axial bore of the casing and the tailpiece of the screw head.

6 Claims, 1 Drawing Sheet

PROPELLING PENCIL

The present invention relates to a propelling pencil for pencil pins, whether coloured or not, with an elongated casing in which an axial bore is provided for placing a pencil pin which near one of its ends has been supplied with a screw thread part, and with a screw head, in which again an axial bore has been made for the pencil lead, which is co-axial to the axial bore of the casing, the screw head having a tailpiece with a screw thread part which has been screwed into the screw thread part of the bore, but can be taken apart, in such a way that the pencil lead is clamped in the tailpiece.

Such propelling pencils are known from e.g. the U.S. Pat. No. 2,170,867, the British patents 20.511, 160.079 and 848.022 and the French patents 802.200 and 1.063.000. The propelling pencils, according to the above mentioned patents, usually have in common that the construction of the clamping device is relatively complex and that the clamping occurs only locally, such that chances are great that the pencil lead will break. Moreover, the clamping is usually such that even when it is loosened, a certain pressure onto the pin remains, such that, when the latter is drawn out, the clamping device of the casing must be loosened entirely, sometimes a special device being needed for drawing out the lead.

One of the essential objects of the present invention is to remedy these disadvantages and, more in particular, to introduce a propelling pencil, in which the pencil lead is clamped over a certain part of its length, such that pressure is spread better over the pencil lead, and no cutting effect is exercised onto the pencil pin. In this way, breaking of the pencil lead is avoided and a same pencil pin can last longer than before.

To this end, according to the invention, said tailpiece comprises at a certain distance of its free end a substantially radially elastically deformable zone, means being provided for squeezing locally and gradually said radially elastically deformable zone of the tailpiece against the pencil lead when the latter is screwed into the bore, without this being the case for said free end itself, such that it does not stick to the pencil lead.

Figure 1:
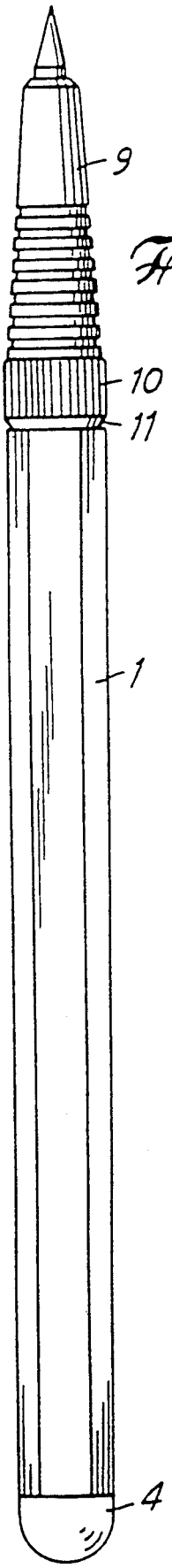
Figure 2:
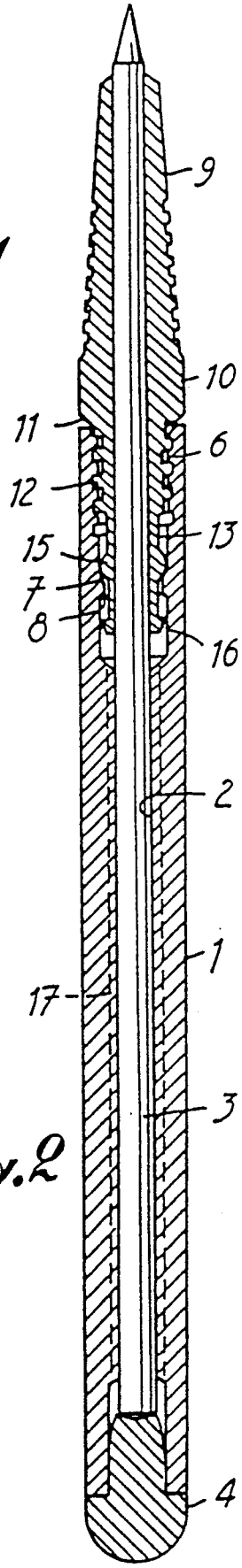
Figure 3:
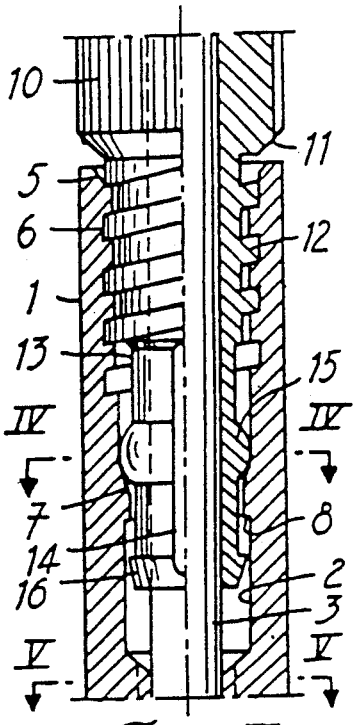
Figure 4:
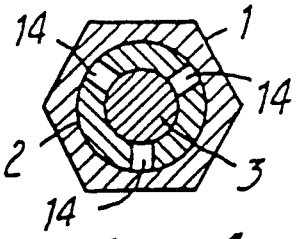
Figure 5:
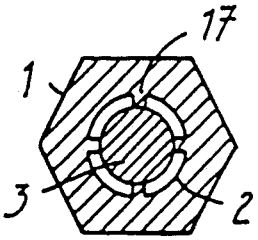

By way of example, hereinafter follows a more detailed description of a chosen, though by no means limited embodiment of the propelling pencil according to the invention. The description refers to the annexed drawings, in which:

FIG. 1 shows an outside view of the propelling pencil;

FIG. 2 provides a longitudinal section thereof;

FIG. 3 is an enlargement of a longitudinal section of the middle part of the propelling pencil;

FIG. 4 provides a cross-section along line IV—IV of FIG. 3;

FIG. 5 provides a cross-section along line V—V of FIG. 3.

In these figures one notices that the propelling pencil comprises an elongated casing or holder 1 and is provided with an axial bore 2 for housing a replaceable pencil lead 3. At one end the axial bore 2 of the casing 1 is shut off by means of a closing cap 4. The other end of the axial bore has a cone-shaped part 5 and comprises a screw thread 6. This screw thread part ends on a cone-shaped part which narrows towards the end or bottom 7 somewhat further on. In the axial bore 2 a ring-shaped deposit 8 has been provided. In the screw thread part 6 of the casing 1, an axially movable screw head 9 has been screwed, which is provided with a ribbed border 10 simplifying the tightening of the screw head. At the bottom of the screw head there is a cone-shaped part 11 which fits into the cone-shaped part 5 of the axial bore 2. A cylindrical or cone-shaped screw thread part 12 of the screw head 9 is set on the tailpiece 13 of the latter. In the tailpiece there are several longitudinal grooves 14 running up to a certain distance of the free end of the tailpiece. Around this tailpiece and about at the height of the middle of the longitudinal grooves 14 a bulb-shaped thickening 15 has been provided, interacting with the cone-shaped part 7 of the axial bore 2 of the casing 1. When the screw head 9 is screwed deeper into the axial bore 2 of the casing 1, the cone-shaped part 7 of the axial bore 2 will exercise a gradually increasing pressure onto the bulb-shaped thickening 15 of the tailpiece 13 of the screw head 9, and thus, thanks to the longitudinal grooves 14 of said tailpiece 13, the middle part of the preferably cylindrical exterior side of the tailpiece starts bending towards the inside, thus exercising a well spread pressure over a certain part of the pencil lead 3 placed in the holder 1 without cutting into it, the pressure sufficing to keep the pencil pin 3 tightly in said holder 1. When unscrewing the screw head 9, the bulb-shaped thickening 15 is again removed from the cone-shaped part 7, such that the pressure on the pencil lead 3 is undone, the part of the tailpiece into which the grooves 14 are provided springing back. When the propelling pencil is then brought into a vertical position with the screw head 9 down, the pencil lead 3, advantageously due to its own weight, will slide out of the screw head 9. At the time the protruding point of the lead 3 is worn off, this will permit in a very simple way, to let a new point out of the screw head 9 or to replace a totally used lead by another, without having to take the screw head entirely out of the casing. To avoid taking the screw head 9 out of the casing 1, it is possible to supply the free end of the tailpiece 13 of the screw head 9 with an exterior cone-shaped brim 16, of which the largest diameter is only slightly bigger than the one of the tailpiece 13 and which takes grip behind the ring-shaped deposit 8, when the screw head 9 is brought into the axial bore 2 of the casing 1. Also, if wanted, a shock-absorbing guide of a flexible plastic or synthetic material (not displayed) can be provided in the axial bore 2 with an intervening space, the guide in this way following the possible bending of the pencil lead and preventing the breaking of the pin.

It is obvious that the shape, size, the mutual mounting of the above described parts and the material out of which the propelling pencil is made, can differ, provided one keeps within the framework of the invention and that at the same time some of these parts could be replaced by others having the same purpose.

Hence, according to the choice of the material out of which the screw head 9 is made, the grooves 14 can be left out. For what matters according to the invention, is that the tailpiece 13, i.e., the part of the screw head 9 which enters the axial bore 2 of the casing 1, has at a certain distance of its free end a substantially radially elastically deformable zone, which is compressed or squeezed when the screwing the screew head 9 into the casing 1 and pressed against the lead 3, such that the latter, while writing, remains stuck in the screw head. Furthermore, it is important that the pin 3 can slide out of the screw head substantially due to its own weight or, if necessary, with a slight shaking, when the screw head is partly loosened, but without taking it out of the casing. To this aim, it is important that, when the screw head is partly loosened, the part of the tailpiece which was stuck against the lead springs back, clearing the latter almost entirely. What matters then is that the inner diameter of the part of the screw head which was not or cannot be compressed, is such with respect to the diameter of the lead, that, when the screw head is partly loosened, the lead can almost freely slide in the screw head. Also, it is a fact that the deformable zone should be bordered by relatively non-deformable zones, to bring about the springing back of the flexible or elastically deformable zone. More in specific, it is necessary that the free end of the tailpiece is made preferably out of a relatively stiff ring-shaped part which does not clamp the pencil lead 3 when the elastically deformable zone is compressed.

In the embodiment described above and shown in the drawings, the screw head 9 is preferably made out of a relatively stiff and hard plastic, more in particular acrylonitrile-butadiene-styrene (ABS), such that, to obtain said elastically deformable zone, the relating longitudinal grooves are provided, which run over a certain distance of the free end of the tailpiece, the end itself thence remaining non-deformable.

If, however, in another embodiment, use is made of a somewhat softer plastic, such as e.g. polyethylene, the grooves can be omitted and the elastically deformable zone can consist of a slightly thinner wall or e.g. a wall provided with thinned rings.

Concerning the screw thread part 12 of the tailpiece, it should be noted that since the screw thread part 6 of the bore 2, with which the former preferably interacts, is slightly cone-shaped narrowing and the screw thread part 12 is cylindrical or cone-shaped, the screw head 9 is tightened in the casing 1 when fixing the lead 3 in the screw head by means of screwing.

What I claim is:

1. A propelling pencil for pencil leads comprising an elongated casing, into which an axial bore is provided for housing a pencil lead, which is provided with a screw thread part near one of its ends, and with a screw head, into which an axial bore for slidably receiving the pencil lead has been provided, which is co-axial to the axial bore of the casing, the screw head having a longitudinally extending tailpiece with a screw thread part which is removably screwed into the screw thread part of the bore so that the pencil lead is clamped in the tailpiece, the tailpiece having at a certain distance of its free end, a substantially radially elastically deformable zone extending along a portion of the longitudinal length of the tailpiece and means being provided to squeeze this radially elastically deformable zone of the tailpiece gradually against the pencil lead when screwing the latter into the bore to keeping the pencil lead tightly in the casing, without any clamping of the pencil lead by said free end of said tailpiece, said means including a cone-shaped part provided in the axial bore of the casing and a ring-shaped thickening around the exterior side of this the radially elastically deformable zone, which can be moved in said cone-shaped part, said ring-shaped thickening having a substantially bulb-shaped surface which interacts with the cone-shaped part of the axial bore of the casing.

2. A propelling pencil according to claim 1, wherein the substantially radially elastically deformable zone of the tailpiece has several longitudinal grooves parallel to said axial bore which run along over a certain distance from the free end of the tailpiece.

3. A propelling pencil according to claim 1, wherein the ring-shaped thickening is provided substantially in the middle part of the longitudinal grooves provided in the tailpiece.

4. A propelling pencil according to claim 1, wherein the axial bore of the casing is provided with an interior deposit, while the tailpiece of the screw head has an exterior brim to prevent the screw head from pulling out of the casing.

5. A propelling pencil according to claim 1, wherein the opening of the axial bore of the casing into which the screw head fits, has a cone-shaped part and wherein the screw head is provided with a cone-shaped part which fits into the cone-shaped part of the axial bore.

6. A propellling pencil for pencil leads comprising an elongated casing, into which an axial bore is provided for housing a pencil lead, which is provided with a screw thread part near one of its ends, and with a screw head, into which an axial bore haivng longitudinal ribs between which the lead placed in the screw lead is guided for slidably receiving the pencil lead which is co-axial to the axial bore of the casing, the screw head having a longitudinally extending tailpiece with a screw thread part which is removably screwed into the screw thread part of the bore so that the pencil lead is clamped in the tailpiece, the tailpiece having at a certain distance of its free end, a substantially radially elastically deformable zone extending along a portion of the longitudinal length of the tailpiece and means being provided to squeeze this radially elastically deformable zone of the tailpiece gradually against the pencil lead when screwing the latter into the bore to keep the pencil lead tightly in the casing, without any clamping of the pencil lead by said free end of said tailpiece.

* * * * *